US006322268B1

(12) United States Patent
Kaufmann et al.

(10) Patent No.: US 6,322,268 B1
(45) Date of Patent: Nov. 27, 2001

(54) EFFICIENT FLUID DISPENSING UTENSIL

(75) Inventors: Rainer Kaufmann, Delmenhorst (DE); Dale E. Harder, Placentia, CA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 09/420,388

(22) Filed: Oct. 19, 1999

Related U.S. Application Data

(63) Continuation-in-part of application No. 08/747,227, filed on Nov. 12, 1996, now abandoned, which is a continuation-in-part of application No. 08/630,515, filed on Apr. 10, 1996, now Pat. No. 6,089,776, which is a continuation of application No. 08/150,085, filed on Nov. 12, 1993, now Pat. No. 6,095,707.

(51) Int. Cl.[7] ..... B43K 5/00

(52) U.S. Cl. ..... 401/198; 401/199

(58) Field of Search ..... 401/198, 199, 401/196, 205; 210/321.87, 321.88, 321.89; 428/32, 37, 903; 502/400; 431/325

(56) References Cited

U.S. PATENT DOCUMENTS

| | | | | |
|---|---|---|---|---|
| 1,166,896 | * | 1/1916 | Garvey | 401/198 |
| 2,740,979 | | 4/1956 | Bridy . | |
| 3,113,336 | | 12/1963 | Langnickel . | |
| 3,479,122 | | 11/1969 | Funahashi . | |
| 3,501,225 | | 3/1970 | Martin et al. . | |
| 3,905,709 | | 9/1975 | Bok . | |
| 3,922,100 | | 11/1975 | Saito . | |
| 3,993,409 | | 11/1976 | Hart . | |
| 4,496,258 | | 1/1985 | Tanaka et al. . | |
| 4,556,336 | | 12/1985 | Sano et al. . | |
| 4,588,319 | | 5/1986 | Niemeyer . | |
| 4,712,937 | | 12/1987 | Schmidt et al. . | |
| 4,770,558 | | 9/1988 | Frietsch . | |
| 4,923,317 | | 5/1990 | Bishop et al. . | |
| 5,087,144 | | 2/1992 | Wada et al. | 401/199 |
| 5,102,251 | | 4/1992 | Kaufmann . | |
| 5,124,200 | * | 6/1992 | Mallonee | 428/296 |
| 5,163,767 | | 11/1992 | Lucas . | |
| 5,192,154 | | 3/1993 | Moeck . | |
| 5,290,116 | | 3/1994 | Chang . | |
| 5,352,052 | | 10/1994 | Kaufmann . | |
| 5,362,168 | | 11/1994 | Abe et al. . | |
| 5,407,448 | | 4/1995 | Brandt et al. . | |
| 5,445,466 | | 8/1995 | Mukunoki . | |
| 5,480,250 | | 1/1996 | Birden . | |
| 5,556,215 | | 9/1996 | Hori . | |
| 5,622,857 | * | 4/1997 | Goffe | 435/378 |
| 5,927,885 | * | 7/1999 | Duez et al. | 401/198 |
| 5,965,468 | * | 10/1999 | Marmon et al. | 442/340 |

FOREIGN PATENT DOCUMENTS

| | | |
|---|---|---|
| 422 575 | 4/1967 | (CH) . |
| 1 885 449 | 1/1964 | (DE) . |
| 1 269 010 | 1/1969 | (DE) . |

(List continued on next page.)

OTHER PUBLICATIONS

PCT International Search Report for PCT/EP 00/05361 dated Sep. 6, 2000 for References BT thorugh BY listed above.

*Primary Examiner*—David J. Walczak
(74) *Attorney, Agent, or Firm*—Squire, Sanders & Dempsey, L.L.P.

(57) ABSTRACT

A fluid dispensing utensil, such as a writing utensil, includes a container (20) defining a first storage area (11) for storing fluid, a second storage area (25) and an opening therebetween, a tip (15), a capillary conveying line (14) extending from the opening through at least a portion of the second storage area to the tip, and a capillary storage (16) associated with the second storage area and in direct contact with the conveying line. A porous shroud (28) may also be provided. Even still, the capillary conveying line and the capillary storage may be a unitary fibrous structure where the fibers are aligned along the longitudinal axis defined by the tip and the opening.

37 Claims, 7 Drawing Sheets

FOREIGN PATENT DOCUMENTS

| | | |
|---|---|---|
| 1 461 588 | 8/1971 | (DE) . |
| 2 124 298 | 11/1972 | (DE) . |
| 1 511 395 | 9/1973 | (DE) . |
| 2 424 918 | 4/1975 | (DE) . |
| 1 808 910 | 9/1979 | (DE) . |
| 3 642 037 | 6/1988 | (DE) . |
| 3 824 941 | 2/1990 | (DE) . |
| PCT/DE92/ 00361 | 4/1992 | (DE) . |
| 4 115 685 | 11/1992 | (DE) . |
| PCT/DE93/ 00989 | 10/1993 | (DE) . |
| 0 210 469 | 2/1987 | (EP) . |
| 0 461 292 | 6/1990 | (EP) . |
| 0 405 768 | 1/1991 | (EP) . |
| 0 459 146 | 4/1991 | (EP) . |
| 0 476 492 | 9/1991 | (EP) . |
| 0 516 538 | 12/1992 | (EP) . |
| PCT/EP93/ 01796 | 7/1993 | (EP) . |
| 0 899 128 | 3/1999 | (EP) . |
| 8 76 10 | 9/1966 | (FR) . |
| 2 528 361 | 3/1983 | (FR) . |
| 2 737 862 | 2/1997 | (FR) . |
| 941439 | 11/1963 | (GB) . |
| 2 205 280 | 12/1988 | (GB) . |
| 2 241 882 | 9/1991 | (GB) . |
| 48-36844 | 2/1967 | (JP) . |
| 7 701 595 | 8/1978 | (NL) . |
| PCT/US91/ 04622 | 6/1991 | (WO) . |

* cited by examiner

EFFICIENT FLUID DISPENSING UTENSIL

CROSS-REFERENCE TO RELATED APPLICATIONS

This application is a continuation-in-part of U.S. application Ser. No. 08/747,227, filed Nov. 12, 1996, now abandoned which is itself a continuation-in-part of U.S. application Ser. No. 08/630,515, filed Apr. 10, 1996, now U.S. Pat. No. 6,089, 776, which is itself a continuation of U.S. application Ser. No. 08/150,085, filed Nov. 12, 1993, now U.S. Pat. No. 6,095,707.

BACKGROUND OF THE INVENTION

1. Field of Invention

The present invention relates generally to fluid dispensing utensils and, more particularly, to a fluid dispensing utensil which is adapted to prevent leakage.

2. Description of the Related Art

Fluid dispensing utensils are commonly used to deliver fluids such as ink, paint, adhesives, shoe polish, lotion, medicine, perfume, makeup, white out and food. In one type of fluid dispensing utensil, a relatively large volume of fluid is stored in a non-capillary container (or reservoir) where it is allowed to move freely. Pens which incorporate such a container, for example, are referred to as "free ink" pens. That is, the ink in the reservoir is usually in a liquid state, and is free to move about as the writing utensil is moved. Fluid in these utensils is transferred from the container to the delivery end (often referred to as a tip or a nib) via a capillary conveying line. A slight vacuum (underpressure) relative to the atmosphere is maintained within the container which prevents fluid in the conveying line from escaping from the utensil until the tip is brought into contact with the surface onto which fluid is to be dispensed. At this point, the force of attraction of the surface and the capillary force of the space between the surface and portions of the tip which are not in direct contact with the surface will cause the fluid to flow from the tip to the surface. As fluid is dispensed, air enters the container in a controlled manner via a precisely sized air inlet that is formed in the container and ends within the fluid. The air replaces the fluid so as to maintain the vacuum at a relatively constant level.

One problem associated with these dispensing devices is leakage caused by air expansion within the container. Specifically, when the air within the container is heated it expands. This causes the vacuum within the container to subside and increases the vapor pressure on the fluid. The reduced vacuum and increased vapor pressure cause the utensil to leak through the tip when oriented in the delivery orientation, i.e. when facing at least partially downwardly.

In an attempt to reduce these types of leaks, some ink pens include an overflow chamber having a capillary storage that will absorb ink. Fountain pens, for example, include a capillary storage in the front section and sometimes under the nib. This storage has a capillarity that is strong enough to prevent leakage when the pen is held in the writing position, but not so strong that it will be filled during a normal writing operation. The capillary storage will not receive fluid when there is substantial air expansion within the container. As a result, these capillary storage systems have been unable to prevent leakage from free ink pens which hold a relatively large volume of ink and, ultimately, a relatively large volume of air. They have also been unable to prevent the leakage caused by relatively large amounts of air expansion in smaller containers.

The storage capacity of existing fountain pen systems which are able to prevent leakage during temperature fluctuations associated with normal use is less than 2.0 milliliters. The reasons for this limitation are as follows. The conveying tube, which transfers fluid via capillary action, must be large enough to produce the desired ink flow during writing. The capillary storage consists of capillaries that must be larger than those of the conveying line. Otherwise, the storage would normally be filled with ink and unable to store excess ink as needed. The storage must also create enough capillary force to hold the ink when the fountain pen is being held vertically. Such force (which is often referred to as "capillary height") is inversely related to the size of the capillaries. Thus, in order to increase the volume of the storage, it is necessary to reduce the size of the capillaries. This is not possible, however, because the storage capillaries must be larger than those of the conveying line, which in turn must be large enough to insure proper ink flow. Accordingly, the volume of liquid that can be stored by the capillary storage is limited. This limits the amount of ink that can be stored in the reservoir.

Other pens include capillary storages configured such that the vast majority of the pores are smaller than the air inlet and are made of a material that is the same or substantially similar to that which forms the conveying line. As a result, the capillary storage will normally be completely filled with fluid and unable to receive additional fluid when air expands within the container. One proposed method of reducing this problem is to reduce the size of the air inlet. The proposed method has proven to be unsuccessful, however, due to manufacturing limitations which make it prohibitively difficult to produce sufficiently small air inlets. Another proposed method of reducing this problem is to increase the size of the storage capillaries. This method has also proven unsatisfactory because the increase in pore size decreases the capillary height of the capillaries and reduces the amount of fluid that can be stored therein when the pen is in the upright position. Thus, to optimize the performance of the conveying line and the storage capillaries, the pore sizes of the conveying line and storage capillaries are preferably carefully controlled.

Still other pens include capillary storages that consist of a series of radially extending fins which form capillaries therebetween. There are a number of disadvantages associated with the fin-type capillary storages. For example, air interferes with the flow of ink back to the reservoir. In addition, fin-type capillary storages take up a relatively large portion of the overall volume of the pen, thereby substantially reducing the amount of volume available for the ink reservoir.

Yet another problem is that the capillary storage swells as it absorbs the excess fluid. The swelling causes the capillary storage to push against the container wall, thereby restricting the air within the capillary storage from releasing freely into the atmosphere, through the surface areas where the storage member pushes against the container wall. The trapped air within the capillary storage, however, prevents the capillary storage from absorbing additional excess liquid. Thus, the swelling limits the capillary storage from absorbing to its full capacity.

OBJECT AND SUMMARY OF THE INVENTION

The general object of the present invention is to provide a fluid dispensing utensil which obviates, for practical purposes, the aforementioned problems in the art. In particular, one object of the present invention is to provide a fluid dispensing utensil which is capable of storing a relatively large volume of fluid without leaking during periods of container air expansion. Another object of the present invention is to provide a fluid dispensing utensil which is relatively inexpensive and easy to manufacture. Yet another objective is to provide a combination of pore sizes in the conveying line and the capillary storage that will channel the flow of fluid to the tip, and not radially to the capillary storage. At the same time, it is important to maximize the flow rate of fluid through the conveying line, so that ample supply of fluid is available for writing.

In order to accomplish these and other objectives, the present fluid dispensing utensil includes a container, a capillary conveying line and a capillary storage in direct contact with the conveying line. The average capillarity of the storage is generally less than that of the conveying line, at least in the area of the opening between the container and the rest of the utensil. In addition, the lowest capillarity of the storage is substantially less than that of the conveying line. That is, the largest pore size in the storage is substantially greater than that of the conveying line. Furthermore, the greatest capillarity of the storage is preferably substantially equal to or less than the lowest capillarity of the conveying line. That is, the capillary storage preferably has very few or no pores smaller than the largest pore of the conveying line, but no pores so large that they cannot hold the height of liquid above the bottom of the reservoir. Due to these features, the vast majority of the capillary storage pores are normally free of fluid and will only store fluid during periods of air expansion in the fluid container. As air in the container contracts back to its original volume, fluid will be drawn out of the storage by the conveying line and returned to the container. The capillary conveying line may be configured such that some of capillaries in the conveying line are relatively small and transfer fluid, while others are relatively large and transfer air. This allows air and liquid to flow in parallel through the conveying line in opposite directions. In addition, the container may be configured such that air is only able to enter the container via the conveying line. Thus, the conveying line may be used to regulate the amount of air flowing into the container.

It should be noted that the descriptive term "capillarity" has been used herein to indicate the height up to which a liquid ascends within a pore of a given diameter. The greater the height, the greater the capillarity. In general, small size pores have greater capillarity than the larger size pores. In other words, the term "capillarity" is indicative of the attractive force between a liquid and a pore.

There are a number of advantages over prior fluid dispensing utensils associated with the present invention. The primary advantage of the present fluid dispensing utensil lies in the fact that it will reliably function under greater temperature fluctuations (and resulting air expansions) than utensils which are presently commercially available. This reliability will also extend to greater fluid storage volumes than commercially available utensils (10 ml or more). This improved reliability will also extend to outside pressure variations, such as those which occur when a utensil is on an airplane. As noted above, fluid saturates the capillary storage in many prior dispensing utensils. This eventually results in undesired leakage. Conversely, the capillary storage in the present invention is substantially emptied each time the air expansion within the container subsides, thereby preventing the aforementioned leakage caused by full storages. In addition, the use of the conveying line as the air inlet eliminates the need to form a very small air inlet in the fluid container. As it is much easier to manufacture capillary conveying lines with pores that are often as small as one one-thousandth of an inch than it is to form an air inlet of similar dimensions in a molded plastic container, a utensil in accordance with the present invention is less expensive to manufacture than prior utensils.

In one embodiment of the invention, the capillary conveying line extends to the bottom (or rearward) area of the container and is surrounded up to the bottom area by a tube. Fluid is unable to enter the conveying line when the utensil is in the dispensing orientation and the conveying line itself becomes the only source of fluid. Thus, this arrangement provides additional protection against leakage.

The conveying line and storage may also be in direct contact with one another. There are a number of advantages associated with this arrangement. For example, as the vacuum in the reservoir increases (due to a temperature decrease) and fluid begins to drain from the capillary storage, the capillaries in the conveying line will absorb essentially 100% of the fluid and return it to the reservoir. This would not occur there was a gap (and, therefore, air) between the storage and the conveying line. First, the conveying line capillaries could not help draw the fluid out of the storage, as they do when in direct contact with the storage. Also, the air would prevent the some of the fluid from entering the conveying line. Thus, after a few air expansion cycles, utensils with a gap will begin to leak.

The conveying line and the capillary storage may, in accordance with another embodiment of the invention, be integrally formed; in other words, a unitary conveying line and capillary storage may be formed. As a result, the conveying line and storage may be manufactured in a single processing step to further reduce manufacturing costs.

In accordance with another advantageous aspect of the invention, an air passage is provided between the exterior surface of the capillary storage and the interior surface of the container. The air passage may be provided in a variety of ways. For example, at least a portion of the exterior surface of the capillary storage may be surrounded by a porous shroud. Alternatively, a substantially rigid element may be arranged between the exterior surface of the capillary storage and the interior surface of the container. Adequate space may also be provided by making the inner surface of the housing rough or irregular. On the storage side, one or more discontinuities may be formed in the exterior surface of the storage.

The air passage is especially useful when the capillary storage is formed from open cell polyurethane foam because certain solvents used in marker inks can cause this type of foam to swell.

Furthermore, capillary storage formed from open cell polyurethane, for example, swells when used with certain solvents. However, if the capillary storage swells to the point that the storage makes continuous contact with the interior surface of the housing, the flow of air from the storage to will be hampered. This can cause leakage when pressure builds within the pen because air will be trapped within the pores in the capillary storage that are needed for ink storage. Accordingly, the passage improves air flow within the pen and provides an additional measure of prevention against leakage.

Another embodiment of the present invention employs fibers that are resistant to swelling caused by certain solvents. For example, polyolefins, which may be any of the polymers and copolymers of the ethylene, propylene, et al. families of hydrocarbons, such as polyethlene or polypropylene, may be used. That is, such fibers are resistant to swelling so that the air within the capillary storage is free to flow from the storage.

To further minimize air within the storage from being trapped, the fibers in the storage may be aligned along the length of the reservoir. That is, porous fibers of the storage are aligned parallel to conveying line. Accordingly, even if the capillary storage does swell, the porous fibers along the side edges are open to allow the air within the storage to flow out of the storage.

The above described and many other features and attendant advantages of the present invention will become apparent as the invention becomes better understood by reference to the following detailed description when considered in conjunction with the accompanying drawings.

BRIEF DESCRIPTION OF THE DRAWINGS

A detailed description of the preferred embodiments of this invention will be made with reference to the accompanying drawings.

DETAILED DESCRIPTION OF THE PREFERRED EMBODIMENTS

The following is a detailed description of a number of preferred embodiments of the invention. This description is not to be taken in a limiting sense, but is made merely for the purpose of illustrating the general principles of the invention.

Figure 1:
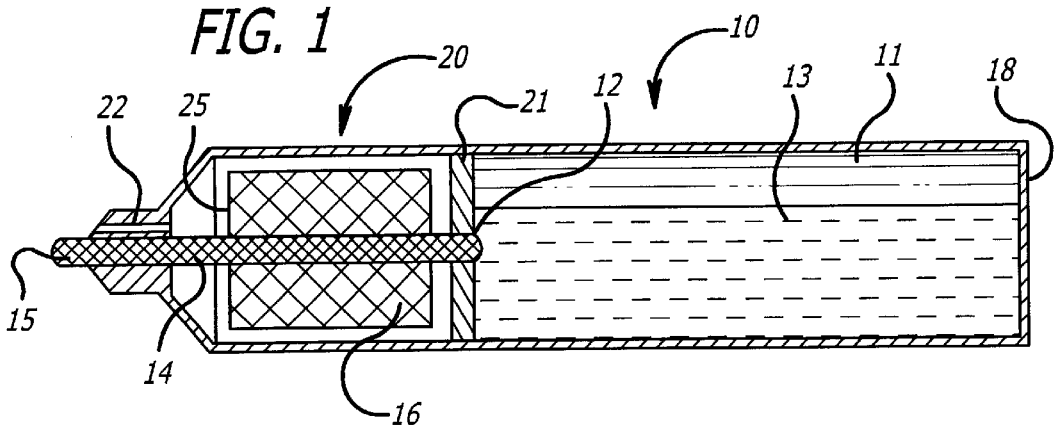
FIG. 1 is a cross-section view of a fluid dispensing utensil in accordance with a preferred embodiment of the present invention.

As shown by way of example in FIG. 1, a preferred embodiment of the present invention (generally represented by reference numeral 10) includes a housing 20 consisting of a container 11 for storing fluid 13 and an overflow chamber 25. Container 11 and overflow chamber 25 may be separated by a partition 21. It is to be understood, however, that partition 21 is only an exemplary representation of the boundary between the container and overflow chamber. An alternate boundary is discussed below with respect to FIG. 7. Container 11 may also be embodied in any suitable manner, either as an integral part of housing 20 or as a separate element connected to the housing. A tip 15 extends from one end of housing 20 in a known manner. An inlet 22 allows air to flow freely in to and out of overflow chamber 25.

Partition 21 includes an opening 12 which, as shown by way of example in FIG. 1, is closed by a capillary conveying line 14. The conveying line extends from opening 12 to tip 15 and is in direct contact with a capillary storage 16. The average capillarity of capillary storage 16 is smaller than the average capillarity of conveying line 14. Although the capillary storage is arranged about the periphery of capillary conveying line 14 in the embodiment shown in FIG. 1, there is no requirement that it extend all the way around the conveying line. Also, the strict separation of capillary storage 16 and conveying line 14 shown in FIG. 1 is not absolutely necessary. With respect to assembly when the conveying line 14 and storage 16 are separate elements, assembly may be performed by wrapping a sheet of storage material around the conveying line and then heat sealing the abutting ends of the wrapped sheet to one another.

The ink in the reservoir is held in place by an "underpressure"(slight vacuum) of the air above the ink, which counteracts the force of gravity pulling on the ink inside the utensil (the head pressure). This underpressure controls the ink flow out of the marker, like a straw full of liquid with a finger over the top which creates a slight vacuum within the straw to hold the liquid therein. The underpressure depends on many factors, such as, the liquid's viscosity, specific gravity and surface tension, the diameter of the tube, the size of the opening at the bottom of the tube, the surface energy of the tube, atmospheric pressure and even temperature all affect how well the liquid wants to stay where it is. The relationship of the above factors as it relates to flow of liquid is listed in the table below.

| Property | High | Low |
|---|---|---|
| Fluid: | | |
| Viscosity | resists flow | flows freely |
| Specific gravity | flows freely | resists flow |
| Surface tension | resists flow | flows freely |
| Tube: | | |
| Diameter | flows freely | resists flow |
| Bottom opening | flows freely | resists flow |
| Surface energy | resists flow | flows freely |
| Atmosphere: | | |
| Pressure | resists flow | flows freely |
| Temperature | flows freely | resists flow |
| Gravity | flows (constant force while on earth) | |

Figure 3:
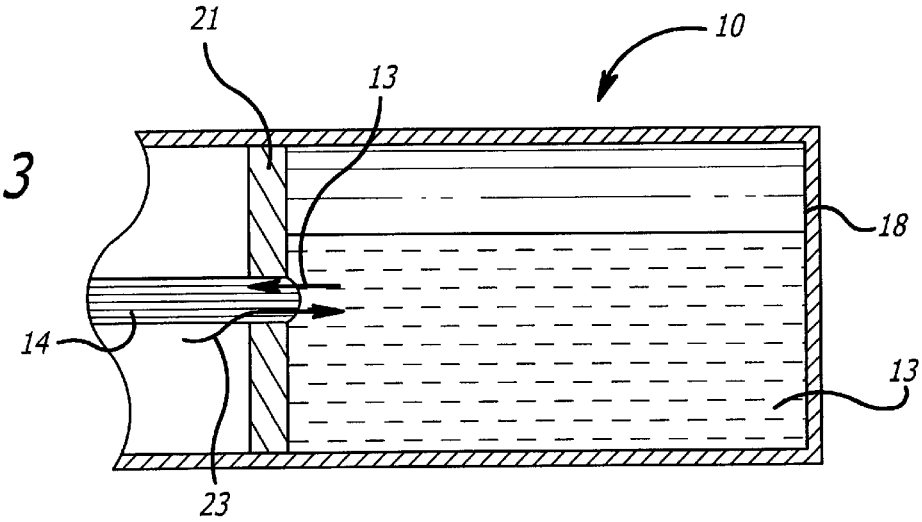
FIG. 3 is a cross-section view of the utensil shown in FIG. 1 illustrating the manner in which air enters the container and fluid exits the container.

As illustrated by way of example in FIG. 3, one way of controlling underpressure is by controlling the largest pore size in the conveying line 14 to control the airflow into the reservoir. For example, during writing, the finer capillaries of the conveying line 14 transfers fluid 13 to the tip. As fluid 13 leaves the reservoir, however, underpressure will increase (this is double negative, so the absolute pressure within the reservoir will decrease). But at the same time, the underpressure will want to remain constant. Thus, to compensate, air 23 is drawn into the container 11 (reservoir) through the largest pore size in the conveying line 14. It has been observed that, under normal writing conditions, air 23 generally enters through a single largest pore in the conveying line 14. Although, in extreme conditions where the change in underpressure is rapid, air may also enter through the next largest pore in the conveying line 14. As such, each individual marker will have its own individual underpressure, due to the variability of the largest pore size from one conveying line to another.

Changes in atmospheric pressure or temperature can affect underpressure. When the external temperature or altitude increases, the underpressure inside the marker decreases (again, this is a double negative, so the absolute pressure inside the marker increases, though still is below ambient). Since the underpressure wants to remain constant, the air volume inside the reservoir increases until the underpressure stabilizes. Because the air volume increases, "excess" liquid will flow down and out of the ink reservoir, i.e. leak out of the writing instrument. To prevent such leakage of liquid, the present invention incorporates an overflow reservoir (storage) that will capture the ink when it needs to, but willingly returns the excess liquid back to the reservoir when the temperature returns to its original temperature.

Similarly, if the temperature or altitude decreases, the underpressure inside the marker increases as well, and any liquid inside the storage will be sucked back into the container 11. If the increase in underpressure is greater than the volume of liquid in the storage, small bubbles of air will be sucked into the marker until the underpressure stabilizes.

As such, the present invention controls air flow to control liquid leakage. That is, liquid flow is an effect of air flow in this system by maintaining underpressure within the reservoir. As discussed above in FIG. 3, air flows through the largest pore in the conveying line 14 and ink flows through the remainder of the smaller pores. Since, it is air flow through the largest pore size in the conveying line 14 that regulates underpressure which regulates how well liquid is held inside the writing instrument, the largest pore size in the conveying line should be carefully selected. For example, if the largest pore size is too large, air will easily flow into the reservoir, the underpressure will be too low, and the marker will not be able to hold very much liquid. Consequently, most of the liquid will flow into the storage, or even out of the marker if the storage is full. On the other hand, if the largest pore size is too small, air flow is restricted, and unable to maintain the underpressure at a constant level as the liquid leaves the reservoir. Consequently, the underpressure will increase, and eventually restricting the liquid within the reservoir from leaving, resulting in a poor writing quality. Thus, to optimize the performance of the writing utensil, the largest pore size in the conveying line cannot be too large or too small, so that the underpressure within in the reservoir can be maintained.

To further optimize the performance of the writing utensil, the smallest pore size in the overflow reservoir (storage) also needs to be carefully selected. As discussed above, capillarity of same materials with smaller pore sizes have higher drawing power to a liquid than larger pore sizes. Since, the storage should only receive excess fluid, the pore sizes in the storage in general should be greater than the pore sizes in the conveying line. However, as the pore sizes increase, the capillarity pull decreases. That is, in the writing position where the writing instrument is held in substantially vertical position, gravity acts upon the liquid absorbed in the storage. Naturally, the greater the height of liquid in the storage in the vertical position, the greater the pulling weight on the liquid within the pores. Consequently, if the pore sizes are too big, then the downward force of gravity will overcome the capillarity force from the bigger pores, and these bigger pores will be unable to hold the excess liquid. Thus, the pore sizes in the storage also needs to be carefully selected.

Following is the relative capillarity relationship of the components that make up the writing utensil, along with the air.

| | |
|---|---|
| Air (anywhere in the system) | capillarity = zero |
| Storage | capillarity = medium |
| Conveying Line | capillarity = high |
| Nib | capillarity = higher |
| Paper | capillarity = highest |

Again, liquid flows from an area of low capillarity to an area of higher capillarity. When writing, the paper having higher capillarity than the nib pulls ink from the nib, Likewise, nib having higher capillarity than the conveying line, pulls the liquid from the conveying line. If there is any ink in larger pores in the storage, they will drain too. In other words, all the liquid flows onto the paper.

During times of decreasing underpressure, (i.e., absolute pressure increases) liquid flows out of the utensil. It flows into all the areas of the marker, filling the areas with the highest capillarity first. Once they fill up, the ink flows into the area of lower capillarity, until it too fills up. Only if the storage were full (lowest capillarity except for air) would the ink have nowhere else to go, and a droplet might form. In the case of our design, however, the volume of storage is adequate to handle all changes in temperature and pressure which may reasonably be encountered. A mixture of porous and/or fibrous materials may be provided which have a distribution of larger and smaller capillaries, such as the distribution shown in FIG. 2, within the material forming the capillary storage and conveying line. As the conveying line is formed from a number of small capillaries that are connected to one another, the same amount of fluid flow may be achieved with a larger single capillary tube. This advantageously allows the size of the storage capillaries to be reduced and the length of the storage increased, thereby increasing storage volume.

The conveying line and storage may be formed from any suitable material. However, such material should have a capillary structure and is preferably a porous material. Exemplary conveying line materials include fibrous materials, ceramics and porous plastics such as that manufactured by Porex in Atlanta, Ga. One exemplary fiber material is an acrylic material identified by type number C10010 that is manufactured by Teibow Hanbai Co. Ltd. This company is located at 10–15 Higashi Nihonbashi 3 Ohome, Chou-Ku, Tokyo 103, Japan. Additionally, the conveying line may also consist of a porous plastic tube which runs from the container to the tip. The end of tube adjacent the tip is closed and regulates air flow into the container. Exemplary storage materials include reticulated foam, which may range from hydrophilic to hydrophobic. The last mentioned type of foam may be used with non-water based liquids. The choice of foam depends, of course, on fluid type. One preferable reticulated foam is Bulpren S90 manufactured by Recticel, which is located at Damstraat 2, 9230 Wetteren, Belgium. Bulpren S90 is an open cell polyurethane foam based on polyester which averages 90 pores per inch. This foam is compressed to ⅓ of its original volume at 180 degrees Celsius to form the storage. This volume is maintained after the foam cools. Other storage materials include ceramics and porous plastics. Furthermore, to minimize swelling of the storage, fibrous material resistant to swelling caused by certain solvents are preferably used. For example, polyolefins, which are any of the polymers and copolymers of the ethylene, propylene, et al families of hydrocarbons may be used, such as polyethlene or polypropylene. Such fibers are resistant to swelling so that the air within the storage 16 are not trapped within the storage. Furthermore, these fibers create porous paths by being bundled together, which permits air and liquid to flow. Fibers with lower density have greater porosity, lower capillarity, and bigger pore sizes. On the other hand, fibers with higher density have lower porosity, greater capillarity, and smaller pore sizes.

The conveying line is press-fit into container opening 12 and provides the only path by which air can enter the otherwise closed fluid container 11. As a result, air flow into the container may be regulated with the conveying line. Specifically, as illustrated in FIG. 3, the finer capillaries of conveying line 14 transfer fluid 13 to the tip. The larger capillaries allow air 23 to enter the fluid container. At a minimum, air will enter through the largest capillary in the conveying line. The size of the larger pores which transport air and the amount that these pores are compressed during the press-fitting process will ultimately dictate the amount of air flow into the container. Container opening 12 and the press-fit portion of conveying line 14 are, therefore, one of the control mechanisms that regulate the flow of air into the container. Other control mechanisms include the capillarity of the conveying line.

Figure 2:
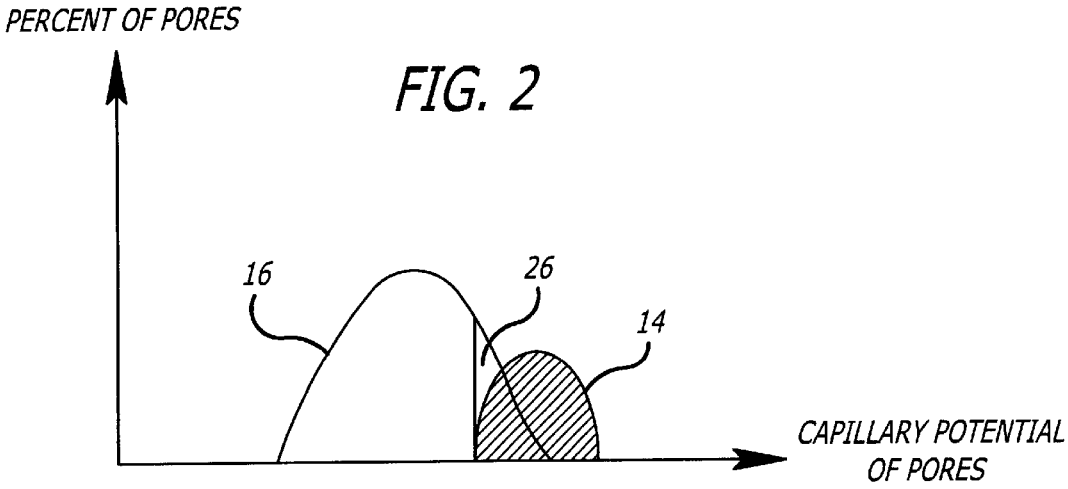
FIG. 2 is a diagram showing, for at least the area adjacent the opening between the container and the capillary storage chamber, the capillary potential of the pores in the capillary storage and capillary conveying line plotted against the percentage of pores.

As illustrated by the exemplary capillarity distribution shown in FIG. 2, the majority of storage 16 has a capillarity that is less than that of conveying line 14. In other words, the majority of the pores in storage 16 are larger than the majority of the pores in conveying line 14. There may be, however, a small percentage of pores in the storage that are smaller than or the same size as the largest air transporting pore in the conveying line. This portion of the storage is represented by the overlapping area 26 of the curves shown in FIG. 2. The few relatively small pores in the storage will normally be filled with fluid, while the larger pores will remain in a fluid-free state until there is air expansion within container 11. Advantageously, the diameter of the biggest pores of the conveying line is less than the average diameter of the pores of the storage.

When air expansion takes place within the container 11, a portion of the fluid in the container will be transferred through opening 12 and conveying line 14 into the normally fluid-free portions of capillary storage 16. In other words, capillary storage 16 receives the "excess" fluid and prevents uncontrolled leakage of the fluid from tip 15, or any other portion of the utensil. The "excess" fluid in capillary storage 16 will return to container 11 through conveying line 14 when the pressure in the container subsides. This process is repeated whenever temperature fluctuations, for example, cause air volume fluctuations within the container. As the fluid stored in capillary storage 16 is always returned to container 11, the capillary storage will not already be filled to capacity when there is an air expansion. Also, even though conveying line 14 is continuously wetted with fluid, at least in the area of opening 12, air cannot interrupt the return of the fluid to the container as long as there is fluid in the capillaries of the storage 16 which are larger than the largest pore in the conveying line 14.

Although the illustrated tip is an integral portion of conveying line 14, the present invention is not limited to such a configuration. The tip may also be a separate structural element, such as a stamp tip, foam tip, roller ball, or razor tip. Also, the size of the tip may be varied, even when the conveying line and tip are unitary, as applications require. Where the tip is formed from a porous material, its pores should be smaller than those of the conveying line in order insure that the fluid in the conveying line will toward the tip during dispensing.

Figure 19:
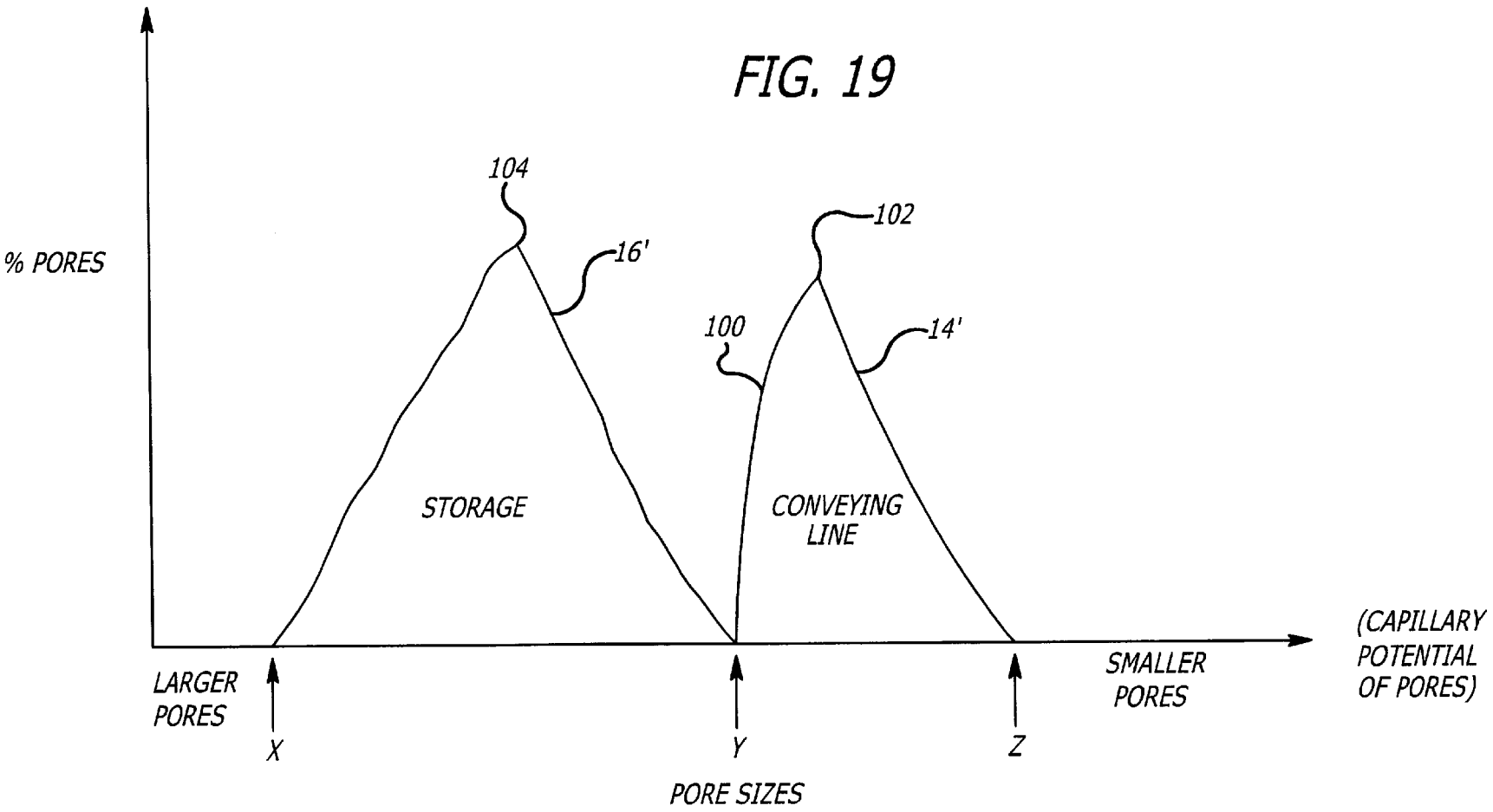
FIG. 19 is a diagram showing an exemplary relationship of pore sizes between a conveying line and storage.

To further optimize the performance of the writing utensil, FIG. 19 illustrates by way of example preferred relationship of pore sizes between the conveying line 14' and the storage 16'. Mark "Y" represents the largest pore size in the conveying line 16', and the preferred lower limit as to the smallest pore size in the storage 16'. Also, as discussed above, it is the largest pore size in the conveying line 14' that regulates underpressure. Preferably, no pores in the storage 16' are smaller than the largest pore in the conveying line 14'. That is, the transition in pore sizes from the storage 16' to the conveying line 14' may be continuous with the smallest pore size in the storage 16' preferably being slightly bigger than the largest pore size in the conveying line 14', or not overlapping to a significant extent. This relationship in pore sizes between the conveying line 14' and the storage 16' optimizes performance of the pen because the storage only absorbs the excess liquid during periods of decreased underpressure within the reservoir (absolute pressure increases), but releases the liquid back to the conveying line 14' when the underpressure increases again (absolute pressure decreases). This way, under normal writing conditions, most, if not all of the fluid is delivered to the tip 15, and not the storage 16'. Preferably, the largest pore size in the conveying line 14', indicated by the mark "Y" on FIG. 19, is in the approximate range of 30 microns to 65 microns.

It should be noted, however, due to the manufacturing variance, there may be an overlap of pore sizes between the conveying line 14' and the storage 16'. That is, there may be some overlap such as plus or minus 5 microns in the pore sizes of the conveying line 14' and the storage 16'. When the pore sizes overlap between the conveying line 14' and the storage 16', some of the liquid will be stored in the storage 16' and not delivered to the tip 15. This condition, although not representing optimal performance of the writing utensil is within the scope of the present invention. Additionally, due to the tolerance there may be a gap between the pore sizes of the conveying line 14' and the storage 16', i.e., the transition of pore sizes from the storage 16' to the conveying line 14' is not continuous as illustrated in FIG. 19. Under this condition, excess fluid will not be most efficiently absorbed by the storage, however, this condition too is within the scope of the present invention.

Another objective of the present invention is to deliver consistent flow of liquid to the tip 15 for high quality writing. However, in situations where the writing utensil is used continuously or in fast strokes, the flow rate of the liquid to the tip 15 may be insufficient to supply enough liquid for high quality writing. In this regard, as explained below, the distribution of pore sizes within the conveying line 14' in FIG. 19 illustrates an exemplary graph that improves the flow rate of liquid in the conveying line 14'.

The flow rate of liquids in the conveying line 14 to a large degree depends on the pore size. For example, flow rate through the conveying line 14' increases as a function of the fourth power of the radius of the pore; this means, increasing the pore size greatly increases the flow rate. In other words, as pore sizes increase, the density of pores in the conveying line 14' decrease, so that there is less resistance to flow of liquid. But increasing the pore size decreases the capillarity of the pore. The capillarity of the pore, however, is only a factor when the pore goes from dry to wet, but once the pore gets wet, the capillarity force is not a significant factor and it becomes a dynamic measurement. That is, capillarity, the attractive force of liquid, is only a factor when the pore is dry; but once the pore is wet, the pore is simply a channel for the liquid to flow therethrough. However, once the pore gets dry again, then the capillarity comes into play.

Accordingly, as illustrated by way of example by side 100 in FIG. 19, a large percentage of the pores in the conveying line 14' are almost big as the biggest pore in the conveying line 14', represented by the mark "Y". This way, once these pores get wet, flow rate is maximized to provide ample amount of liquid to the tip 15. In this regard, to maximize the flow rate of liquid in the conveying line 14', the distribution of pore sizes between the biggest pore size "Y" and the smallest pores size "Z" in the conveying line are preferably narrow, with the majority of the pore sizes only slightly smaller than the biggest pore size "Y." Here, the difference between "Y" and "Z" may be 50 microns depending on the manufacturing tolerance. However, a distribution range that is less than 5 microns is preferred, i.e., difference between "Y" and "Z" is less than 5 microns. This way, majority of the pores in the conveying line are only slightly smaller than "Y."

It should be noted that narrowing the distribution range of the pore sizes will generally increase the peak 102 representing the percentage of pores for the graph 14'. For example, a conveying line 14' having a distribution range of 40 microns may have a peak 102 in the range of 30% to 40%. However, the peak 102 may increase as the distribution range is further narrowed. Alternatively, having a peak 102 that is substantially flat, i.e., graph 14' that is substantially rectangular, will lower the peak 102 to a lower percentage.

With regard to the distribution of pores in the storage 16'; as discussed above, the pore sizes in the storage cannot be so big that they cannot hold the excess liquid. However, the size of the pores should be also balanced to maximize the pore volume. The pore volume is the amount of pore spaces available in the storage to hold a certain volume of liquid. The pore volume can be increased by either increasing the pore sizes within the storage or increasing the size of the storage itself. The later is less desirable because increasing the size of the storage increases cost of manufacturing and requires bigger construction of the writing utensil. Thus, it is preferred that the pore sizes in the storage are balanced instead, so that the pores are small enough to hold excess liquid, yet big enough to maximize pore volume.

In this regard, graph 16' illustrated by way of example in FIG. 19 provides such balance in storage pore sizes as discussed above. Here, mark "X" represents the biggest pore size in the storage 16'. Exemplary difference between "X" and "Y", may be approximately 60 microns. Here, the peak 104 for the graph 16' is approximately 30% to 40% of pores. For example, if the peak 104 represented 95 microns along the horizontal axis for pore size, and 35% for the vertical axis, then that would mean that 35% of the pores are 95 microns in the storage. Preferably, the difference between points "X" and "Y" is approximately 25 microns.

Figure 4:
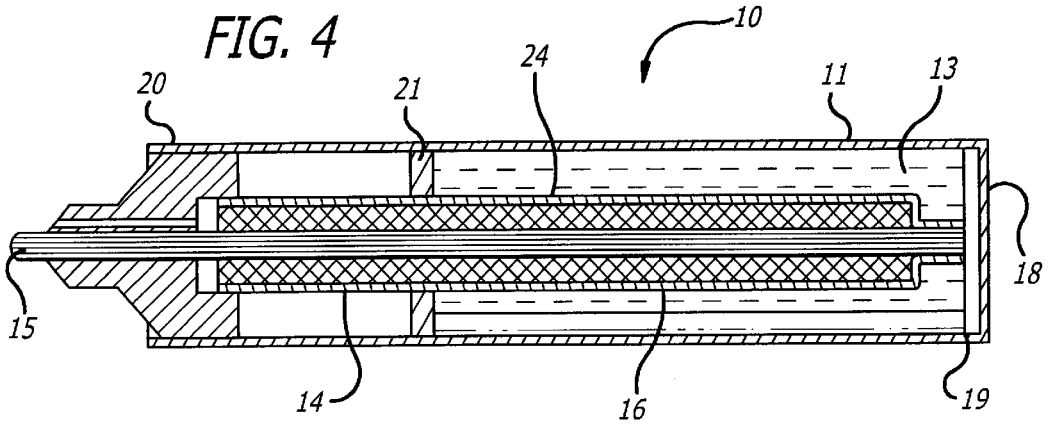
FIG. 4 is a cross-section view of a fluid dispensing utensil in accordance with another preferred embodiment of the present invention.
Figure 6:
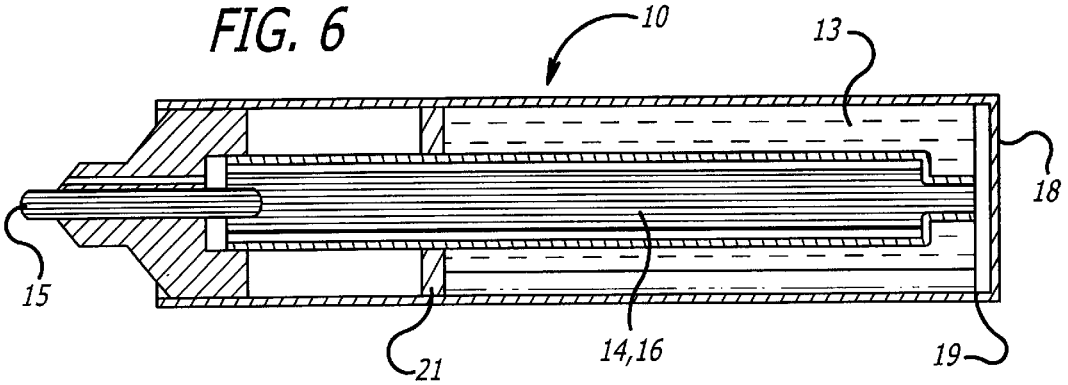
FIG. 6 is a cross-section view of a fluid dispensing utensil in accordance with still another preferred embodiment of the present invention.

Turning to the exemplary embodiments illustrated in FIGS. 4 and 6, conveying line 14 may be configured such that it extends into area 19 near container bottom 18. In these embodiments, the capillary storage and the capillary conveying line are enclosed by a tube 24. The tube provides additional protection against unwanted leakage. When the utensil is in the dispensing orientation, i.e., with the tip facing downwardly, the flow of fluid from the container to the conveying line is interrupted. The interruption occurs because there will not be any fluid in area 19, the only area from which fluid can transferred to the conveying line. The conveying line itself is essentially the only source of fluid.

The embodiment shown in FIG. 4 differs slightly from the embodiment shown in FIG. 6. Specifically, in the embodiment shown in FIG. 4, capillary storage 16 and capillary conveying line 14 are separate structural elements and the conveying line extends into bottom area 19. In the embodiment shown in FIG. 6, a mixture of porous materials having the requisite combination of capillary sizes form a unitary capillary storage 16 and conveying line 14.

Figure 5:
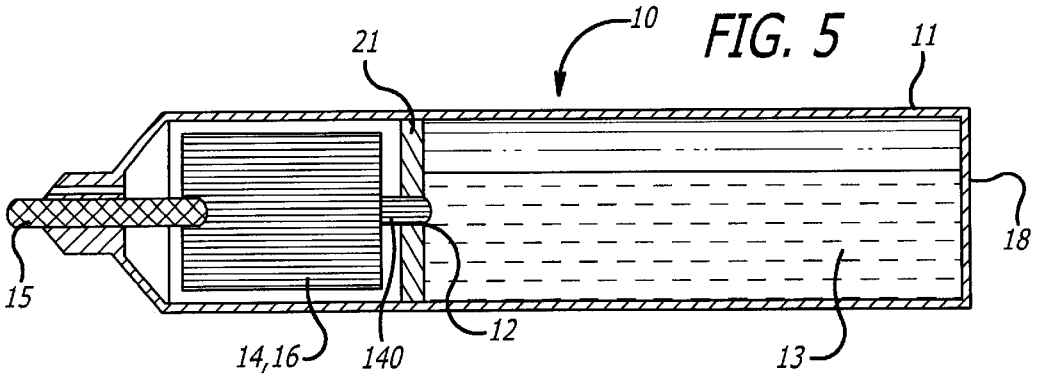
FIG. 5 is a cross-section view of a fluid dispensing utensil in accordance with still another preferred embodiment of the present invention.

In the exemplary embodiment shown in FIG. 5, conveying line 14 and capillary storage 16 define a unitary structural element similar to that shown in FIG. 6. In this embodiment, however, rear portion 140 of the integral conveying line and capillary storage is tapered so that it may be received in opening 12. In order to ensure that there is a sufficient amount of fine, fluid transferring capillaries in the container opening, this portion of the combined conveying line/storage may be pinched together at the opening in a defined manner. Rear portion 140 may also be provided as a separate element that is connected to the capillary storage.

Figure 7:
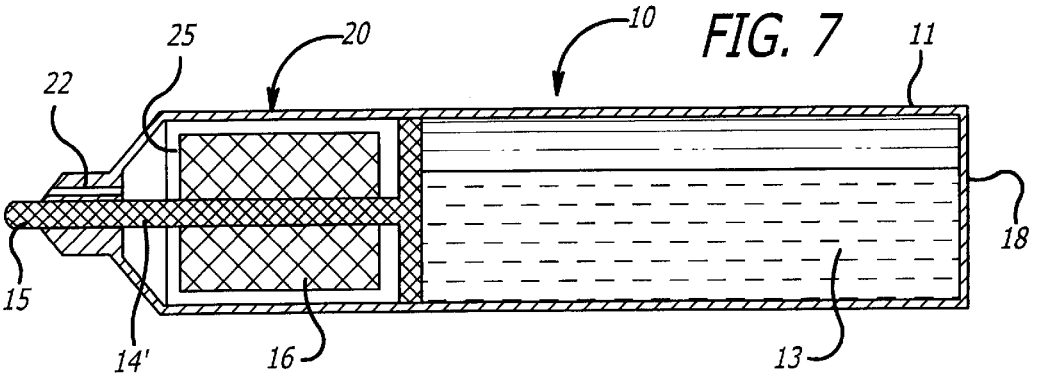
FIG. 7 is a cross-section view of a fluid dispensing utensil in accordance with yet another preferred embodiment of the present invention.

As shown by way of example in FIG. 7, capillary conveying line 14' may be configured such that it includes a radially extending portion that separates the container from the overflow chamber. The conveying line and radially extending portion fill the opening between the container and the overflow chamber. The pores in the radially extending portion may be substantially similar to those in the conveying line and allow air to pass, but block the flow of fluid. As a result, the radially extending portion may be used to regulate the flow of air into the container.

Figure 8:
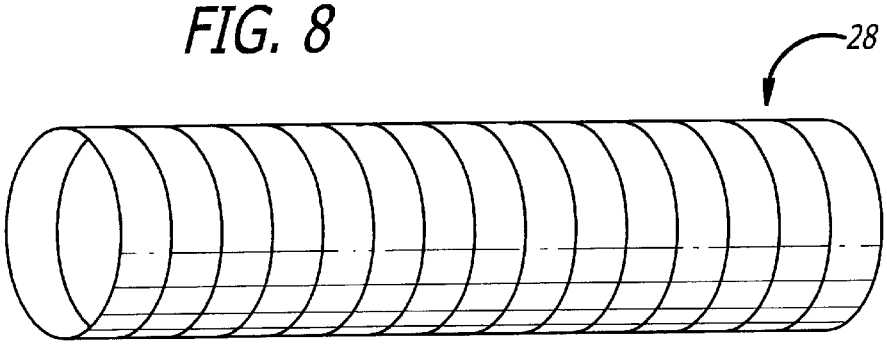
FIG. 8 is a perspective view of a capillary storage shroud in accordance with another preferred embodiment of the present invention.
Figure 9:
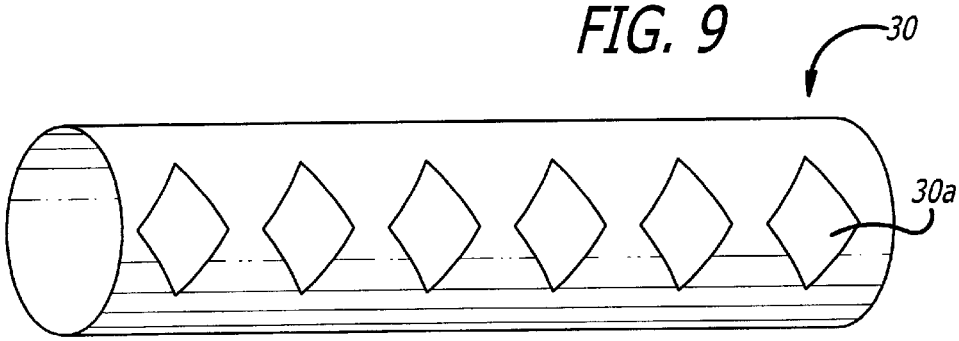
FIG. 9 is a perspective view of a capillary storage shroud in accordance with another preferred embodiment of the present invention.
Figure 10:
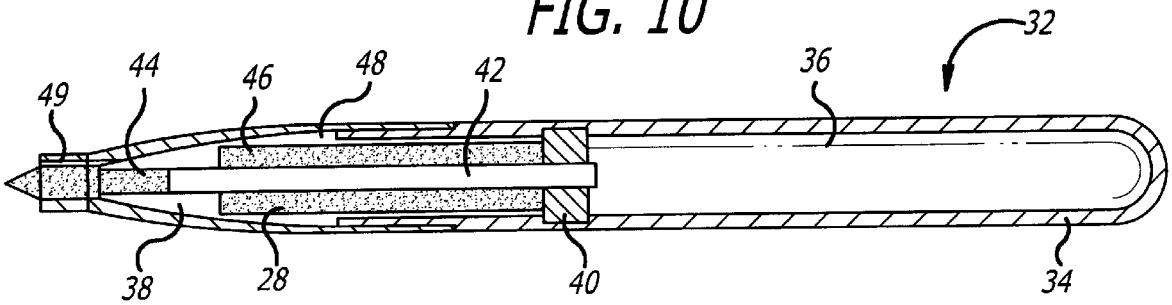
FIG. 10 is a cross-section view of a fluid dispensing utensil including a shroud.
Figure 11:
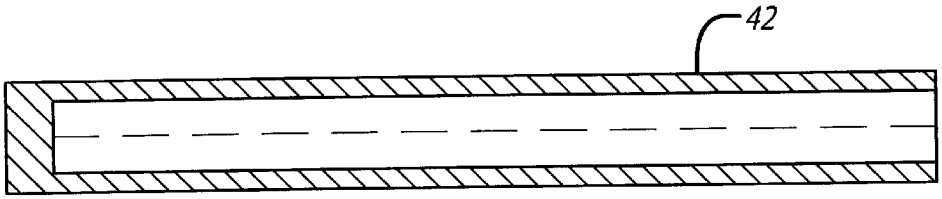
FIG. 11 is a cross-section view of a hollow feeder tube which may be used in conjunction with the utensil shown in FIG. 10.

Referring to FIGS. 8–10, a porous shroud, such as shrouds 28 and 30, may be placed in an exemplary utensil 32 (such as a pen) in the manner shown in FIG. 10. Exemplary utensil 32 includes a housing 34 divided into a container 36 and a chamber 38 by a partition 40. A conveying line 42, which may be of the solid type described above or a hollow porous plastic conveying line (or tube) such as that shown in FIG. 11, extends from the container 36 through the chamber 38 to a tip 44. Use of a hollow plastic feeder tube decreases flow resistance between the container 36 and the tip 44. A capillary storage 46 within the chamber 38 is in direct contact with the conveying line 42. A porous shroud (exemplary shroud 28 is shown) surrounds the capillary storage 46 and prevents the storage from expanding to the point at which it makes continuous contact with the inner wall of the housing 34, thereby forming an air gap 48. The air gap 48 provides a passage that allows air to flow out of the utensil through an inlet 49 when pressure within the container 36 rises and liquid is forced from the container through the larger capillaries in the conveying line 42. As shown FIG. 10, the inner wall of the housing 34 in the area of the chamber 38 tapers inwardly near the tip 44. The storage 46 and surrounding shroud 28 may be press fit into the overflow chamber. Of course, the press fit is not air-tight.

The porous shroud may take a variety of forms and be composed of any material which will both resist swelling of the capillary storage 46 and allow to air flow therethrough. For example, exemplary shroud 28 may be formed from a number of porous materials including, but not limited to nylon mesh, fabrics, and papers. The fabrics may be adhesive bonded to the storage material prior to shaping the capillary storage around the conveying line. Exemplary shroud 30 is formed from plastic and includes perforations 30*a*.

Figure 12:
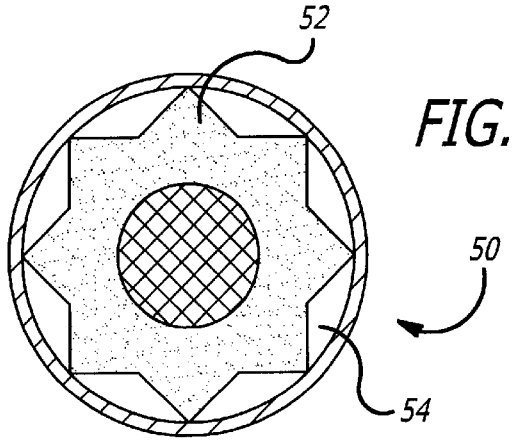
FIG. 12 is a cross-section view of a fluid dispensing utensil in accordance with still another preferred embodiment of the present invention.
Figure 13:
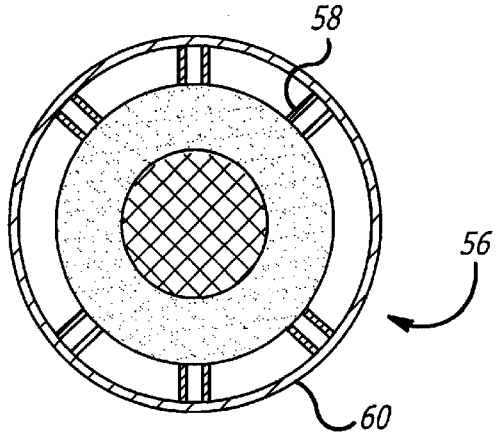
FIG. 13 is a cross-section view of a fluid dispensing utensil in accordance with yet another preferred embodiment of the present invention.
Figure 14:
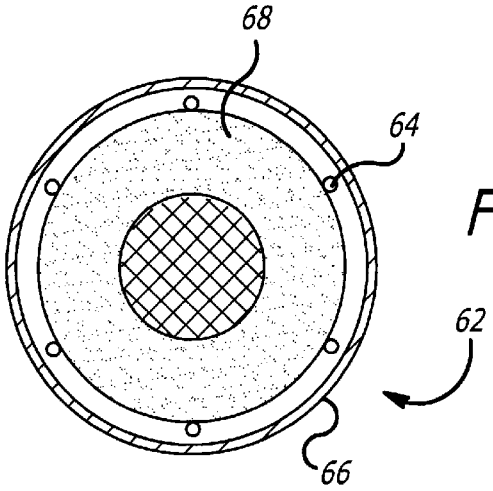
FIG. 14 is a cross-section view of a fluid dispensing utensil in accordance with another preferred embodiment of the present invention.

As shown by way of example in FIGS. 12–14, an air passage may be formed between the capillary storage and the interior of the housing by creating irregular surfaces therebetween. The irregular surfaces prevent the capillary storage from making continuous contact with the interior surface of the housing when the storage swells, thereby insuring that there will be a gap to accept air from the storage. Referring more specifically to the exemplary utensil 50 shown in FIG. 12, the capillary storage 52 is substantially star-shaped and has a series of depressions 54 formed therein. Exemplary utensil 56, which is shown in FIG. 13, includes a series of longitudinal ribs 58 which extend inwardly from the inner surface of the housing 60. The exemplary utensil 62 shown in FIG. 14 includes a series of longitudinally extending rods 64 that are inserted between the housing 66 and the capillary storage 68. Rods 64 may be replaced by capillary tubes. Adequate space may be provided by simply making the inner surface of the housing rough or irregular.

In addition to the methods of preventing capillary storage swelling described above, foams that are resistant to the swelling caused by certain solvents, such as polyethylene foam, may be employed if they possess the other necessary properties. The capillary storage may also be formed from alternate materials (that have the requisite capillarity) such as standard marker filler materials and porous plastics. Referring back to FIG. 5, an enlarged view of the unitary conveying line 14 and capillary storage 16 is illustrated by way of example in FIGS. 15 and 16, with the smallest pore size near the center, and the pore sizes generally increasing radially. Note that in FIGS. 15 and 16, the conveying line and the storage are referred to as 14' and 16', respectively; to illustrate another exemplary distribution of pore sizes between the conveying line 14' and storage 16', as shown in FIG. 19. FIG. 17 illustrates an exemplary cross-sectional view of distribution of the pore sizes in the unitary conveying line 14' and capillary storage 16', which is consistent with the, shown in FIG. 19. Note that the distinction between the conveying line 14≧ and the capillary storage 16' is determined by the predetermined pore size "Y". That is, in this embodiment, the pore sizes smaller than "Y" are categorized as the pores in the capillary storage 16', and pore sizes equal to or greater than "Y" are categorized as the pores in the conveying line 14'.

As discussed earlier, one of the objectives of the present invention is to deliver most if not all of the liquid to the tip by ensuring that the storage only receives "excess" liquids. In this regard, as illustrated by way of example in FIG. 16, a piercing conduit 150 is shown which funnels the fluids from the reservoir to the center of the unitary channel 153. The piercing conduit 150 has a first opening 154 that is larger than a predetermined second opening 156. The first opening 154 seals the opening 12, and the predetermined second opening 156 is associated with the unitary capillary channel 14', 16'. The piercing conduit 150 in this embodiment is shaped like a funnel to optimize (minimize resistance to) the flow of fluid from the reservoir to the unitary channel 152.

Preferably, the predetermined second opening 156 is substantially associated with the conveying line 14' as defined above; that is, the fluids through the predetermined opening 156 preferably only wets the pores in the conveying line 14'. Here, since the pores in the conveying line 14' are smaller than the pores in the storage, only excess fluids will be absorbed by the pores in the storage; at the same time, since majority of the pores are almost big as the biggest pore size "Y", the flow rate through the conveying line 14' is optimized.

Figure 15:
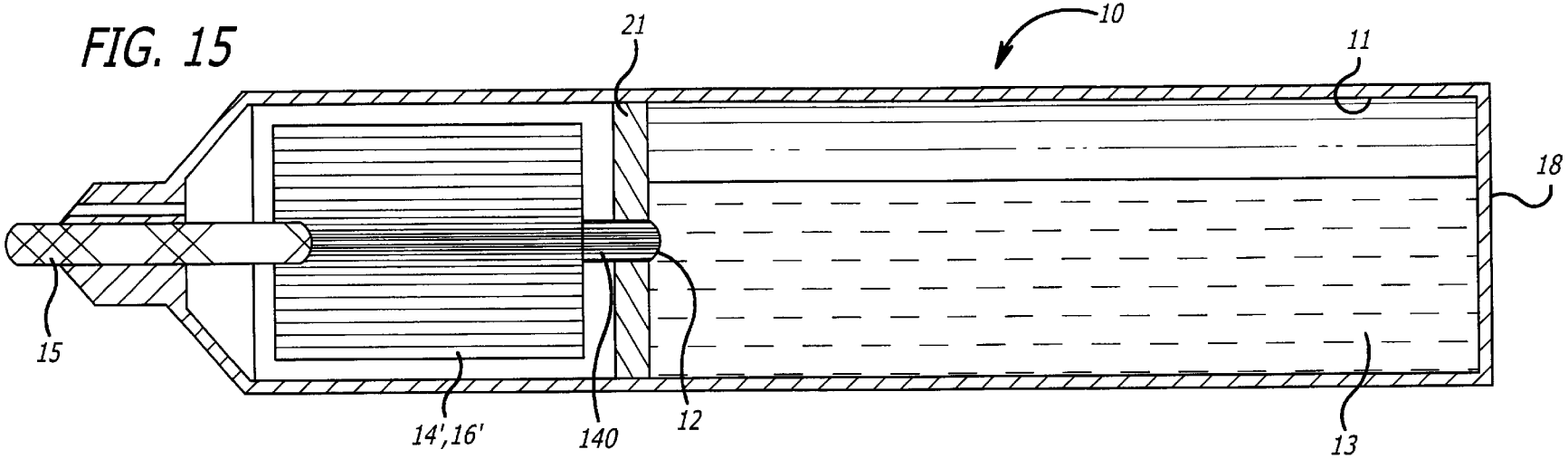
FIG. 15 is a cross-section view of a fluid dispensing utensil in accordance with yet another preferred embodiment of the present invention.

Also, as illustrated by way of example in FIGS. 5 and 15, the fibers in the storage 16 are aligned parallel to conveying line 14 to allow air within the storage 16 to freely exchange with the atmosphere even after the capillary storage swells. Here, since the fibers in the storage are aligned with the conveying line 14, the openings of the storage fibers are exposed on the surface areas 157 and 158 of the storage 16. As such, since the surface areas 157 and 158 do not come in contact with the container wall, the air within the storage fibers are free to flow out of the storage.

Yet another embodiment is illustrated by way of example in FIG. 18. Here, unlike the unitary channel member 152 shown in FIG. 16, a separate conveying line 14' and a storage member 16' are shown. Consistent with the preferred distribution of pore sizes shown in FIG. 19, mark "Z", which represents the smallest pore size the conveying line 14' is preferably located along the center line of the conveyor line 14'. From the center of the conveying line 14', the pore sizes preferably increase radially with the largest pore size preferably located along the surface of the conveyor line 14', represented by mark "Y".

With regard to the storage 16', it has an opening 160 to receive the conveying line 14'. The smaller pore sizes of the storage 16' are preferably near the surface of the opening 160. Accordingly, the larger pore sizes of the conveying line 14' are preferably in direct contact with the smaller pore sizes of the storage 16'. The direct contact between the conveying line 14' and the storage 16' is generally represented by mark "Y" in FIG. 19. Again, the pore sizes in the storage 16' increase radially with the larger pore sizes preferably on the exterior surface of the storage 16', with the biggest pore size represented by mark "X". When assembled, the conveying line 14' is preferably fit snugly into the storage member 16' without any gaps between the conveying line 14' and the storage 16'.

The conveying line 14' may also vary in length, so that the end 162 may extend from the storage 16'. The extending end 162, for example may be press fitted into container opening 12 and provide the only path by which air can enter the otherwise closed flow container 11. Alternatively, the end 162 may be flush against the back end of the storage member 16', there the piercing plug 150 may be coupled to the end 162 to deliver the fluid from the container 11. Additionally, the conveying line 14' may also extend from the storage 16' and still further extend outside of the container 10 to form a tip 15.

Figure 16:
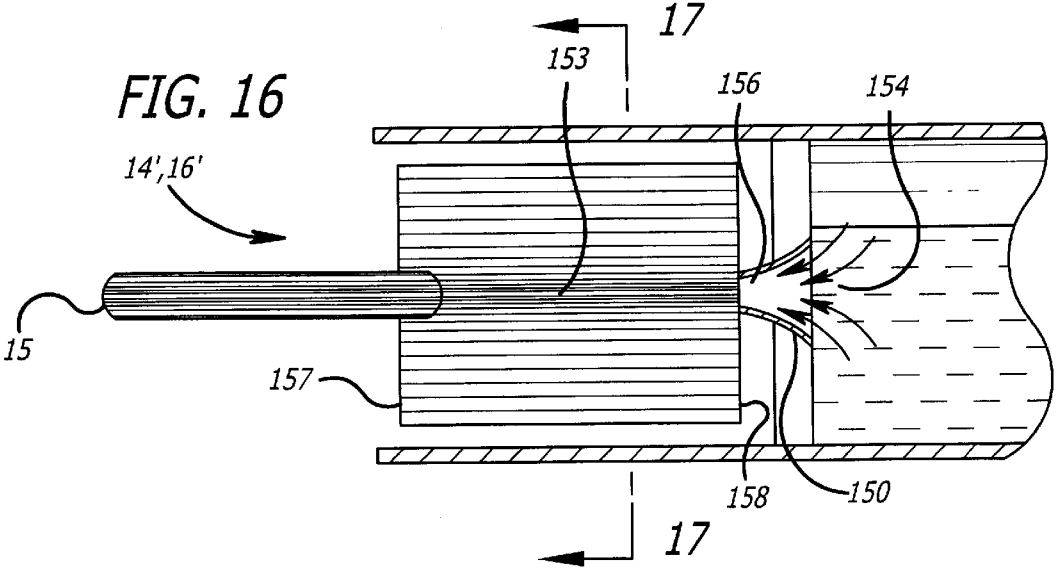
FIG. 16 is an enlarged cross-section view of a unitary conveying line and storage shown in FIG. 15, in accordance with another preferred embodiment of the present invention.
Figures 17, 18:
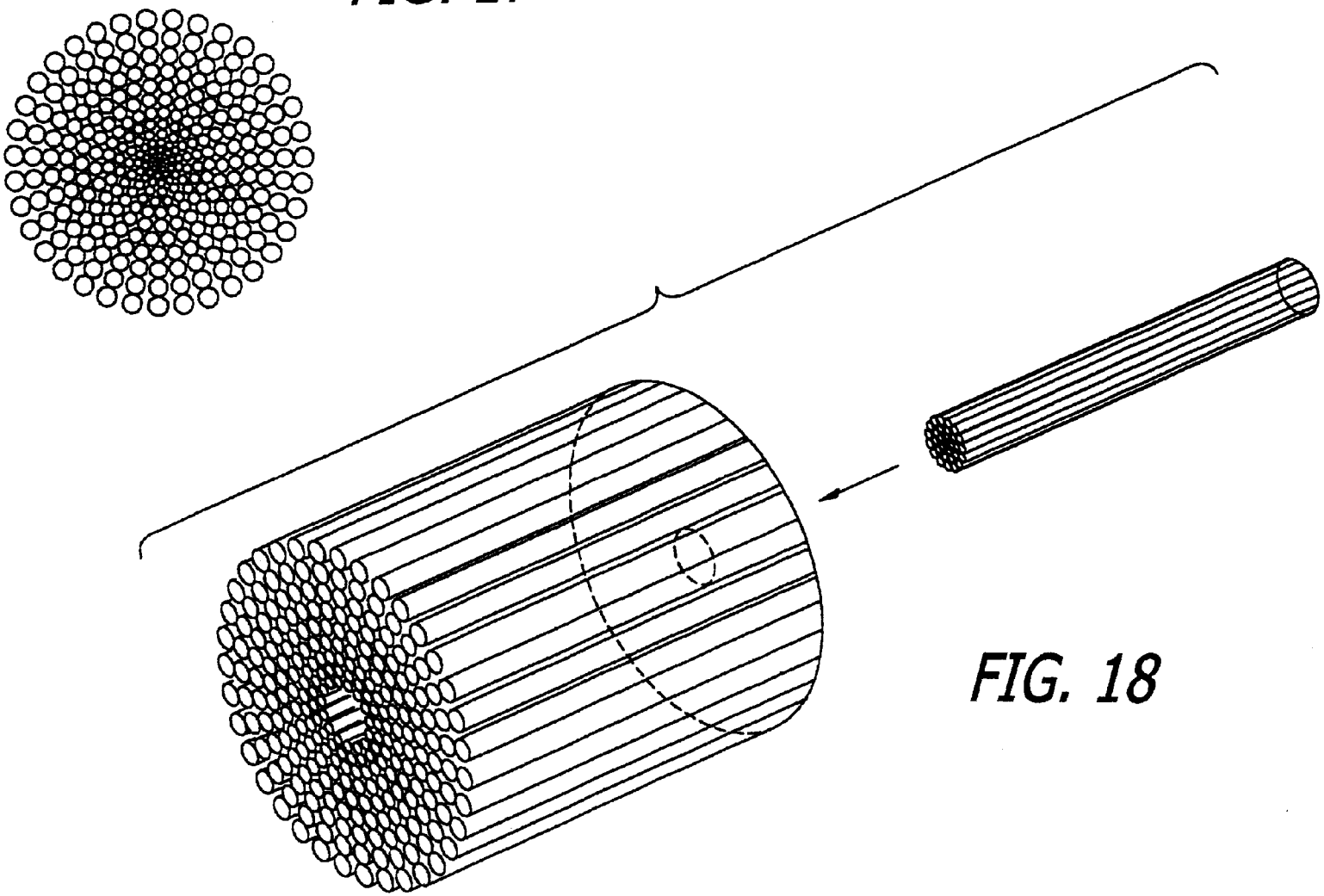
FIG. 17 is a cross-sectional view of the unitary conveying line and storage shown in FIG. 16 along 17—17.
FIG. 18 is a perspective view of a conveying line and a storage with pores aligned longitudinally.

With regard to the above embodiments illustrated in FIGS. 15 to 17, both the unitary and the separate conveying line and storage may be obtained from Porex Technologies, located at 500 Bohanon Road, Fairbum, Ga. 30213, and also from Filtrona Richmond, located at 8401 Jefferson Davis HWY., Richmond, Va. 23237.

With respect to the fluid itself, the present invention is capable of storing and dispensing a variety of fluids. For example, where the utensil is to be used as a pen, then ink is used. Other fluids include deodorant, perfume, medicines such as acne medicine, balms, lotions, makeup, lipstick, paint, adhesives (whether microencapsulated or not), white out, shoe polish and food stuffs. In order to accommodate these different types of fluids, the pore size and pore volume of the conveying line and storage must be varied in accordance with the viscosity and particle size of the fluid. For example, when the fluid is a typical writing fluid, the diameters of the capillaries (or pores) in the conveying line may range from 0.01 mm to 0.05 mm and the capillary (or pore) diameters in the storage may range from 0.02 mm to 0.5 mm, with a distribution similar to that shown in FIG. 2. Pore sizes and volumes are increased for larger particle sizes and higher viscosities and, conversely, are reduced for smaller particle sizes and lower viscosities.

Although the present invention has been described in terms of the preferred embodiment above, numerous modifications and/or additions to the above-described preferred embodiments would be readily apparent to one skilled in the art. For example, the utensil may be of the "break seal to initiate" variety. Such utensils include a stopper that prevents fluid from entering the conveying line until the consumer is ready to use the utensil for the first time. This keeps the both the fluid and the conveying line fresh. Another exemplary modification is the addition of a secondary reservoir located near the tip. Such a reservoir could have a capillarity similar to that of the conveying line and would increase the amount of fluid available during dispensing. It is intended that the scope of the present invention extends to all such modifications and/or additions and that the scope of the present invention is limited solely by the claims set forth below. Also, it is applicant's intention that the claims not be interpreted in accordance with the sixth paragraph of 35 U.S.C. §112 unless the term "means" is used followed by a functional statement.

What is claimed:

1. A fluid dispensing utensil, comprising:

a container defining an interior surface, the container being separated into a first storage area for storing fluid and a second storage area with an opening therebetween;

a tip;

a conveying line made of porous fiber bundles filling the opening and extending from the opening through at least a portion of the second storage area to the tip, wherein the fibers of the conveying line are aligned with the longitudinal axis of the conveying line; and a capillary storage made of a porous fiber bundle and associated with the second storage area, the capillary storage being in direct contact with the conveying line, wherein the fibers of the storage are aligned with the longitudinal axis of the conveying ine, wherein the fibers of the capillary storage create larger voids than the fibers of the conveying line.

2. The fluid dispensing utensil according to claim 1, wherein a predetermined pore size is the largest pore size in the conveying line.

3. The fluid dispensing utensil according to claim 2, wherein air passes through the predetermined pore size.

4. A fluid capillary channel associated with a fluid source, comprising:

an inlet adapted to be coupled to the fluid source;

a tip; and a plurality of fibers bundled along a longitudinal axis from the inlet and the tip, wherein the bundle of fibers has a varying effective pore size, and wherein the effective pore size of the bundle of fibers generally increases continuously and radially from the longitudinal axis.

5. The fluid capillary channel according to claim 4, includes a predetermined effective pore size defining a conveying line and a storage, wherein the pore sizes equal to or smaller than the predetermined effective pore size in the capillary channel define the conveying line, wherein the pore sizes larger than the predetermined effective pore size in the capillary channel define the storage.

6. The fluid capillary channel according to claim 5, wherein air passes through the predetermined effective pore size.

7. The fluid capillary channel according to claim 5, wherein the predetermined effective pore size is approximately between 30 microns to 65 microns.

8. The fluid capillary channel according to claim 7, wherein a substantial majority of the pore sizes in the conveying line are within 5 microns of the predetermined effective pore size.

9. The fluid capillary channel according to claim 8, wherein the smallest pore size of the conveying line is within 50 microns of the predetermined effective pore size.

10. The fluid capillary channel according to claim 8, wherein the largest pore size in the storage is within 60 microns of the predetermined effective pore size.

11. The fluid capillary channel according to claim 4, wherein the plurality of fibers are aligned along the longitudinal axis from the inlet to the tip.

12. The fluid capillary channel according to claim 4, wherein the fibers are made of a polyolefin material.

13. The fluid capillary channel according to claim 4, wherein the fibers are made of a polyethylene material.

14. The fluid capillary channel according to claim 4, wherein the plurality of fibers form a substantial cylindrical shape.

15. The fluid capillary channel according to claim 4, wherein the plurality of fibers form a unitary conveying line and a storage.

16. The fluid capillary channel according to claim 4, including a conduit coupling the fluid source to the inlet of the capillary channel.

17. The fluid capillary channel according to claim 16, wherein the conduit has a large opening and a smaller opening, the larger opening facing the fluid source and the smaller opening associated with the inlet of the capillary channel.

18. An efficient fluid dispensing utensil, comprising:

a container defining an interior surface, the container being separated into a first storage area for storing fluid and a second storage area with an opening therebetween;

a feeder terminating at a tip; and a unitary capillary channel associated with the second storage area, the capillary channel having a rear end and a second end, the rear end of the capillary channel coupled filling the opening between the first and second storage areas, the feeder coupled to the second end of the capillary channel, wherein the unitary capillary channel is comprised of a plurality of fibers aligned along a longitudinal axis between the rear end and the tip, wherein the plurality of adjacent fibers provide porous paths along the fibers having an effective pore size, and wherein the effective pore size of the plurality of porous fibers generally increases radially from the longitudinal axis;

whereby said unitary capillary channel normally acts to convey fluid directly from said conduit to said tip through centrally located fiber paths, and upon excess flow of fluid resulting from overpressure in said first storage area, the fluid may be stored in porous volumes associated with said longitudinally extending fibers which are radially outward from said centrally located fibers.

19. The fluid dispensing utensil according to claims 18, wherein the unitary capillary channel defines a conveying line and a storage.

20. The fluid dispensing utensil according to claim 19, including a predetermined effective pore size defining the largest pore size in the conveying line, and wherein said storage includes pore sizes greater than the predetermined effective pore size.

21. The fluid dispensing utensil according to claim 20, wherein air passes through the predetermined effective pore size.

22. The fluid dispensing utensil according to claim 20, wherein the predetermined effective pore size is approximately between 30 microns to 65 microns.

23. The fluid dispensing utensil according to claim 20, wherein the smallest pore size in the conveying line is within 5 microns of the predetermined effective pore size.

24. The fluid dispensing utensil according to claim 20, wherein the smallest pore size of the conveying line is within 50 microns of the predetermined effective pore size.

25. The fluid dispensing utensil according to claim 20, wherein the largest pore size in the storage is within 60 microns of the predetermined effective pore size.

26. The fluid dispensing utensil according to claim 20, wherein the smallest pore size of the storage is substantially equal to or larger than said predetermined effective pore size.

27. A combination of a conveying line and a capillary storage for conveying liquid through the conveying line and storing any excess liquid in the capillary storage, comprising:

a conveying line having a distribution from a smallest capillarity to a largest capillarity, wherein between the smallest capillarity and the largest capillarity of the conveying line is an average capillarity, the conveying line having a proximal end and a distal end, the distal end adapted to be in direct contact with liquid in a storage area; and a capillary storage having a distribution from a smallest capillarity to a largest capillarity, wherein between the smallest capillarity and the largest capillarity of the capillary storage is an average capillarity, the capillary storage having an opening at least partially through its longitudinal axis, wherein the conveying line is adapted to be inserted into the opening of the capillary storage and at least a portion of the capillary storage is in direct contact with the conveying line, such that the capillary storage only comes into contact with the liquid in the storage area by way of the conveying line, wherein the smallest capillarity of the conveying line is at least equal to the largest capillarity of the capillary storage.

28. A combination according to claim 27, wherein the smallest capillarity of the conveying line is substantially equal to the largest capillarity of the capillary storage.

29. A combination according to claim 27, wherein the largest capillarity of the capillary storage is greater than the smallest capillarity of the conveying line.

30. A combination according to claim 27, wherein the smallest capillarity of the conveying line is greater than the average capillarity of the capillary storage, but less than the largest capillarity of the capillary storage.

31. A combination according to claim 27, wherein the largest capillarity of the conveying line is greater than the largest capillarity of the capillary storage.

32. A combination according to claim 27, wherein the largest capillarity of the conveying line forms an air passage to flow air into the storage area to compensate for liquid leaving the storage area.

33. A combination according to claim 27, wherein the capillary storage is made from a porous material.

34. A combination according to claim 27, wherein the capillary storage is made from reticulated foam ranging from hydrophilic to hydrophobic.

35. A combination to claim 27, wherein the capillary storage is made from polyolefins.

36. A combination according to claim 27, wherein the conveying line is formed from fibrous materials.

37. A combination according to claim 27, wherein the proximal end of the conveying line is adapted to associate with a tip.

* * * * *